US007358900B2

(12) United States Patent
Song et al.

(10) Patent No.: US 7,358,900 B2
(45) Date of Patent: Apr. 15, 2008

(54) SYMMETRIC-SLOT MONOPOLE ANTENNA

(75) Inventors: Jia-Jiu Song, Taipei County (TW); Jr-Ren Jeng, Taipei (TW)

(73) Assignee: SmartAnt Telecom.Co., Ltd., Hsinchu (TW)

( * ) Notice: Subject to any disclaimer, the term of this patent is extended or adjusted under 35 U.S.C. 154(b) by 64 days.

(21) Appl. No.: 11/225,182

(22) Filed: Sep. 14, 2005

(65) Prior Publication Data

US 2007/0057846 A1 Mar. 15, 2007

(51) Int. Cl.
*H01Q 1/38* (2006.01)

(52) U.S. Cl. ..... 343/700 MS; 343/846

(58) Field of Classification Search ..... 343/700 MS, 343/767, 770, 846, 848, 893
See application file for complete search history.

(56) References Cited

U.S. PATENT DOCUMENTS

| | | | | |
|---|---|---|---|---|
| 5,532,707 | A * | 7/1996 | Klinger et al. | 343/793 |
| 6,133,883 | A * | 10/2000 | Munson et al. | 343/700 MS |
| 6,191,751 | B1 * | 2/2001 | Johnson | 343/834 |
| 6,344,823 | B1 * | 2/2002 | Deng | 343/700 MS |
| 6,411,261 | B1 * | 6/2002 | Lilly | 343/756 |
| 7,053,855 | B2 * | 5/2006 | Huang | 343/843 |
| 2004/0008146 | A1 * | 1/2004 | Ikegaya et al. | 343/767 |
| 2005/0231435 | A1 * | 10/2005 | Ikegaya et al. | 343/767 |

* cited by examiner

*Primary Examiner*—Hoanganh Le
(74) *Attorney, Agent, or Firm*—Harness, Dickey & Pierce P.L.C.

(57) ABSTRACT

A symmetric-slot monopole antenna is provided, including a metallic board. Formed on the metallic board are a ground connection part to provide a ground circuit for the monopole antenna and a radiation part formed integrally on the ground connection part to receive and radiate signals transmitted through a signal cable.

10 Claims, 7 Drawing Sheets

SYMMETRIC-SLOT MONOPOLE ANTENNA

BACKGROUND OF THE INVENTION

1. Field of Invention

The present invention relates to a monopole antenna, more particularly, to a symmetric-slot monopole antenna.

2. Related Art

With the development of wireless communication, miniaturization is the trend of the design of electronic devices. In order to comply with the trend, the size of antenna needs to decrease. At present, the widely used small-sized antenna include planar antenna and chip antenna. There are many types of planar antenna, such as micro-strip antenna, printed antenna, and planar inverted-F antenna (PIFA). In general, printed dipole antenna are commonly used in wireless communication devices. In terms of its design, a dipole antenna has a radiation part that extends to the two ends of the antenna and therefore is of a long antenna structure. Thus, the miniaturization of electronic devices for wireless communication are hard to realize. Further, the manufacture of printed antenna is complicated and is costly.

In order to increase the speed of wireless transmission, MIMO (multiple-input multiple-output) antennas have become increasingly popular. An MIMO antenna uses a plurality of independent antennas which are connected separately to different signal processing circuits. As an example, for an MIMO antenna with three independent antennas, two of the independent antennas are used to transmit signals and the other one is used to receive signals. By assigning different functions to different independent antennas, the speed of signal-transmission is increased. Under this situation, if the above-described printed antenna structure was adopted, the overall size of the antenna would be even larger, and the current demand for miniaturization of electronic devices could not be met.

Therefore, how to provide a low-cost and easy-to-produce antenna has become an important topic of research.

SUMMARY OF THE INVENTION

In order to solve the problems above, one objective of the present invention is to provide a symmetric-slot monopole antenna made from a metallic material and made integrally to replace printed antenna, to thereby reduce the manufacturing cost and simplify the manufacturing processes.

In order to achieve this objective, a symmetric-slot monopole antenna includes a metallic board having a ground connection part and a radiation part.

The ground connection part has a long narrow slot connected to the ground connection terminal of the signal cable to provide a ground circuit. The ground connection part may be of any geometric shape (e.g., triangle, rectangle, circle, or half circle).

The radiation part is formed integrally with the ground connection part and has a signal feeding hole connected to the signal terminal of the signal cable. The radiation part is formed perpendicular to the plane of the ground connection part to receive and radiate signals and the length of the radiation part is ¼ λ(wavelength). Further, the radiation part may be connected to the ground connection part by means of welding (i.e., non-integral structure).

The symmetric-slot monopole antenna may include two impedance matching slots formed on a metallic board, with the two impedance matching slots corresponding to a long narrow slot of the ground connection part to match the impedance of the symmetric-slot monopole antenna.

Further, in order to achieve the above objective, in another exemplary embodiment of the present invention, the symmetric-slot monopole antenna of the present invention includes a metallic board having a ground connection part and more than one radiation part.

The ground connection part has more than one long narrow slot connected to the ground connection terminal of the signal cable to provide a ground circuit. The ground connection part may be any of geometric shape (e.g., triangle, rectangle, circle, or half circle).

More than one radiation part is formed integrally on the ground connection part, wherein each radiation part has a signal-feeding hole connected to the signal terminal of the signal cable. The radiation parts are formed perpendicular to the plane of the ground connection part to receive and radiate signals, with the length of each radiation part being ¼ λ(wavelength). Further, each radiation part may be formed on the ground connection part by means of welding (i.e., a non-integral structure).

The above-described symmetric-slot monopole antenna is an MIMO antenna. Each radiation part corresponds to two impedance matching slots and each of the impedance matching slots is formed on a metallic board and corresponds to a long narrow slot on the ground connection part to match the impedance of the symmetric-slot monopole antenna.

The symmetric-slot monopole antenna according to the exemplary embodiments of the present invention may replace printed dipole antenna to therefore reduce the size of antenna, and further reduce the cost and simplify the processes of antenna manufacture.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1A:
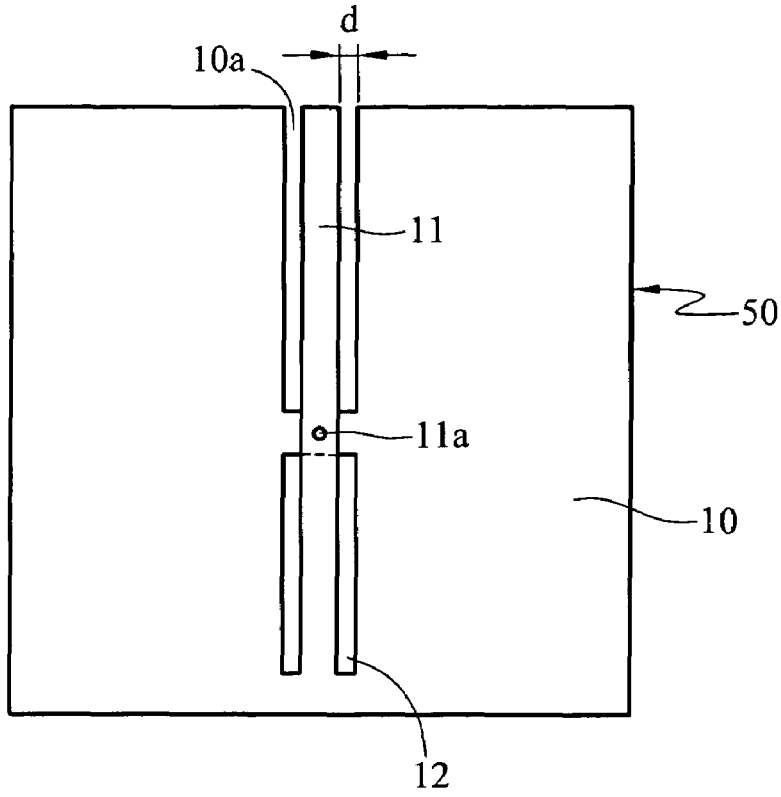
FIG. 1A is a plan view of a symmetric-slot monopole antenna according to a first exemplary embodiment of the present invention.

FIG. 1 is a plan view of a first exemplary embodiment according to the present invention. In FIG. 1, the symmetric-slot monopole antenna 50 is made from a metallic board (e.g., copper board or steel board.). A ground connection part 10, a radiation part 11, and an impedance matching slot 12 are formed on the metallic board.

The ground connection part 10 has a long narrow slot 10*a* connected to the ground connection terminal 20*a* of the signal cable 20 to provide a ground circuit for the symmetric-slot monopole antenna 50. The ground connection part 10 may be of any geometric shape (e.g., a triangle, a rectangle, a circle, or a half circle).

The radiation part 11 is formed integrally with the ground connection part at the end of the long narrow slot 10*a* and may be folded up to a position approximately perpendicular to the plane of the ground conncetion part 10 as shown in FIG. 1 B to receive and radiate signals. When the radiation part 11 is not folded up, each of its two sides is separated from the ground connection part 10 by a distance d, with the length of the radiation part 11 being ¼ λ (wave-length). The radiation part 11 has a signal-feeding hole 11*a* to provide a connection between the symmetric-slot monopole antenna 50 and the signal terminal 20 *b* of the signal cable 20 to receive signals. Further, the radiation part 11 may be of a narrow strip shape or any other geometric shape, and may be further folded to reduce the size of the symmetric-slot monopole antenna 50.

Formed on the ground connection part 10, the impedance matching slot 12 symmetrically corresponds to the long narrow slot 10*a*. By adjusting the shape, size, quantity, and/or angel of the impedance matching slot 12, the impedance value and the radiation pattern of the monopole antenna may be changed.

Figure 1B:
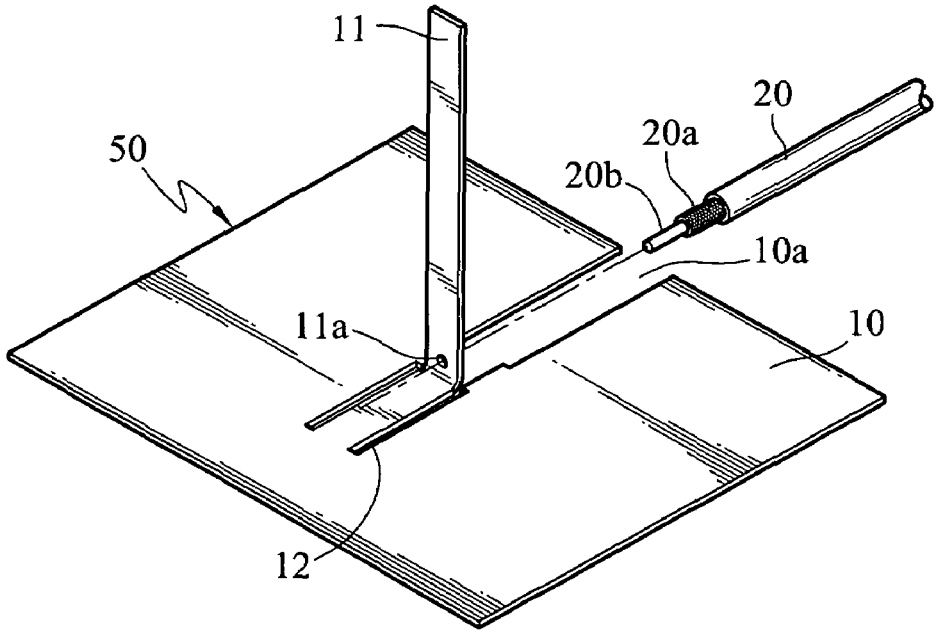
FIG. 1B is a three-dimensional view of the symmetric-slot monopole antenna according to a first exemplary embodiment according to the present invention.

FIG. 1B is a three-dimensional view of the first exemplary embodiment according to the present invention. The radiation part 11 is formed by means of cutting out a long narrow slot 10*a* on the ground connection part 10. Then the radiation part 11 is folded up to a position approximately perpendicular to the plane of the ground connection part 10, while the signal feeding hole 11*a* is connected to the signal terminal 20*b* of the signal cable 20 to receive signals. The ground connection terminal 20*a* of the signal cable 20 is connected to the ground connection part 10. Therefore, the symmetric-slot monopole antenna 50 has a length of only half of that of a dipole antenna, and its size is thus significantly reduced.

Further, the radiation part 11 may be formed on the ground connection part 10 by means of welding (i.e., non-integral structure), which will not affect the radiation pattern of the monopole antenna.

Figure 2A:
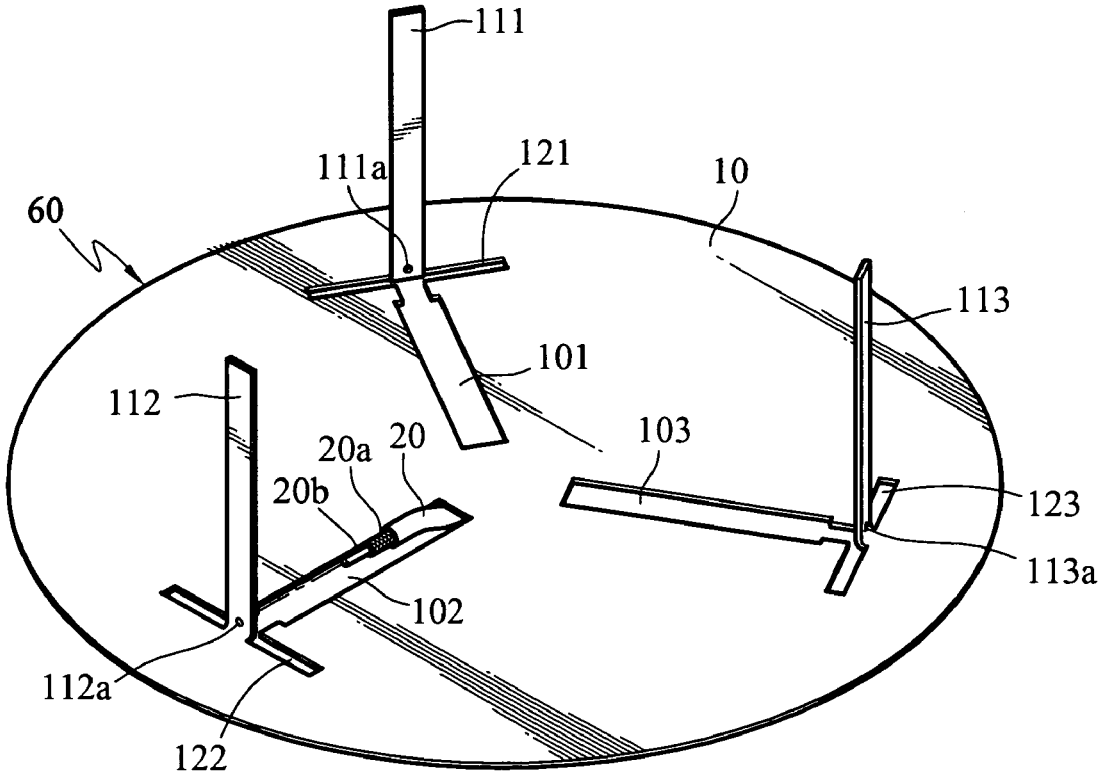
FIG. 2A is a three-dimensional view of a symmetric-slot monopole antenna according to a second exemplary embodiment of the present invention.
Figure 2B:
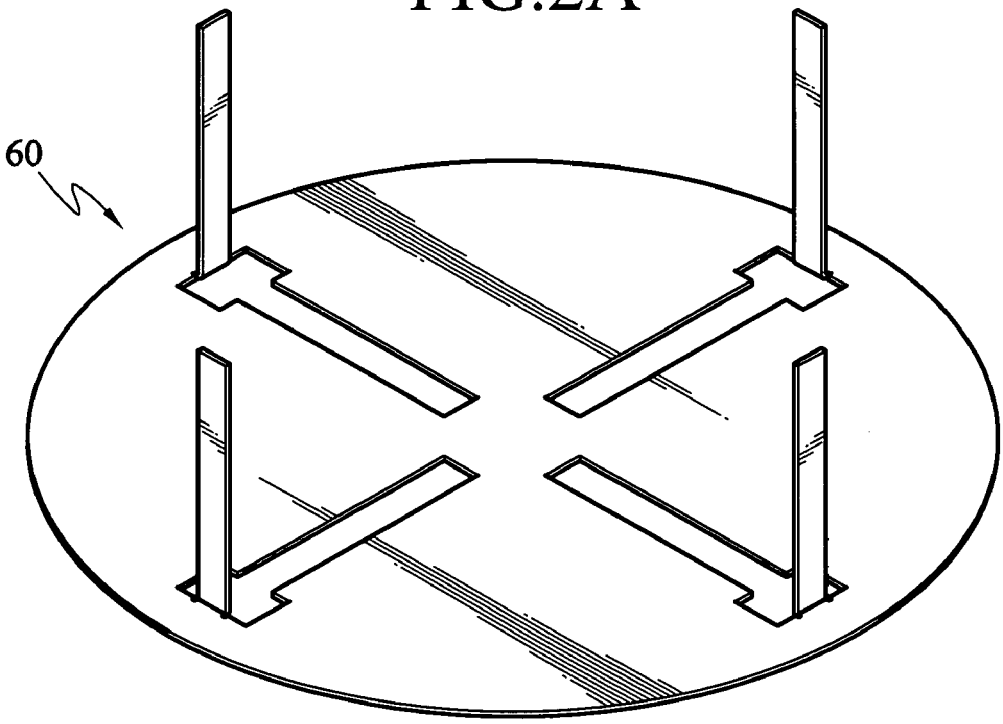
FIG. 2B is a three-dimensional view of a symmetric-slot monopole antenna according to a modified second exemplary embodiment of the present invention.
Figure 2C:
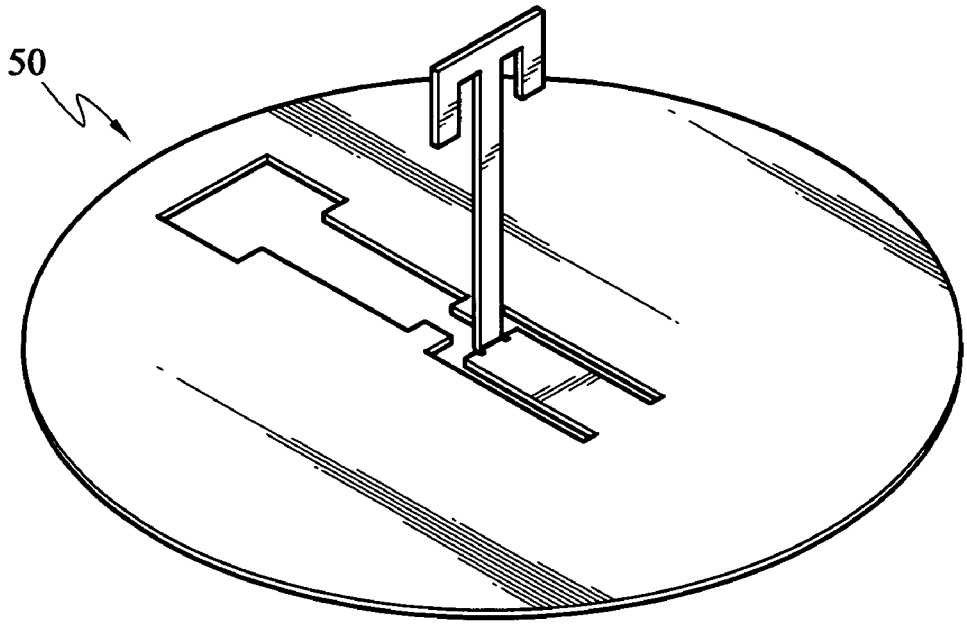
FIG. 2C is a three-dimensional view of a symmetric-slot monopole antenna according to a modified second exemplary embodiment of the present invention.
Figure 2D:
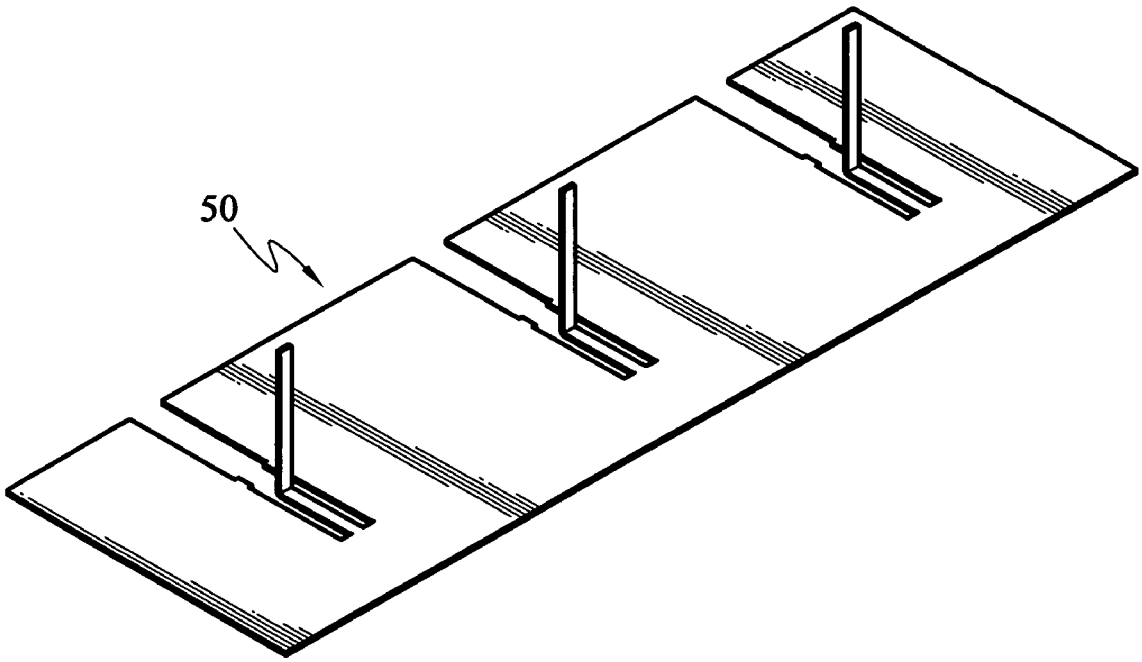
FIG. 2D is a three-dimensional view of a symmetric-slot monopole antenna according to a modified first exemplary embodiment of the present invention.

FIG. 2A is a three-dimensional view of a second exemplary embodiment of the present invention. In FIG. 2A, the symmetric-slot monopole antenna 60 is made from a metallic board (e.g. copper board or steel board) and is an MIMO (multi-input multi-output) antenna. Formed on the metallic board are a ground connection part 10, a first radiation part 111, a second radiation part 112, and a third radiation part 113.

The ground connection part 10 includes a first long narrow slot 101, a second long narrow slot 102, and a third long narrow slot 103 connected to the ground connection terminal of the signal cable 20 (for simplicity, only one signal cable is depicted in FIG. 2A) to provide a ground circuit for the symmetric-slot monopole antenna 60. The ground connection part 10 may be of any geometric shape (e.g., triangle, rectangle, circle, or half circle).

The first radiation part 111 is formed integrally with the ground connection part 10 and connected to the end of the first slot 101. The first radiation part 111 corresponds to an impedance matching hole 121 and may be folded up to a position approximately perpendicular to the plane of the ground connection part 10 to receive and radiate signals. The first radiation part 111 is of a length of ¼ λ (wave-length), and has a signal feeding hole 111*a* to provide a connection between the symmetric-slot monopole antenna 60 and the signal terminal 20*b* of the signal cable 20 to receive signals. Further, the first radiation part 111 may be in a shape of a strip or any other geometric shape, and may even be folded, which reduces the size of the symmetric-slot monopolo antenna 60.

The second radiation part 112 is formed integrally with the ground connection part 10 and connected to the end of the second long narrow slot 102, and corresponds to the impedance matching slot 122. The second radiation part 112 may be folded up in a position approximately perpendicular to the plane of the ground connection part 10 to receive and radiate the signals. The length of the second radiation part 112 is ¼ λ (wavelength), and has a signal feeding hole 112*a* to provide a connection between the signal terminal 20*b* of the signal cable 20 and the symmetric-slot monopole antenna 60 to receive signals. Further, the second radiation part 112 may be in the shape of a strip or any other geometric shape, and may even be folded, which may reduce the size of the symmetric-slot monopole antenna 60.

The third radiation part 113 is formed integrally with the ground connection part 10 and connected to the end of the third long narrow slot 103, and corresponds to the impedance matching slot 123. The third radiation part 113 may be folded up to a position approximately perpendicular to the plane of the ground connection part 10 to receive and radiate signals. The third radiation part 113 is of a length of ¼ λ (wavelength), and has a signal feeding hole to provide a connection between the signal terminal 20*b* of the signal cable 20 and the symmetric-slot monopole antenna 60 to receive signals. Further, the third radiation part 113 may be in the shape of a strip or any other geometric shape, and may even be folded, which may reduce the size of the symmetric-slot monopole antenna. Each of the radiation parts may be formed on the ground connection part 10 by means of welding (i.e., non-integral structure), which will not effect the radiation pattern of the monopole antenna.

Further, the number of radiation parts in the second exemplary embodiment may be increased to four as shown in FIG. 2. The radiation part may be designed to be in the shape of a "T" as shown in FIG. 2C. Multiple symmetric-slot monopole antenna 50 according to the first exemplary embodiment of the present invention may be arranged in a row or a column as shown in FIG. 2D to form an MIMO (multi-input multi-output) antenna.

Figure 3A:
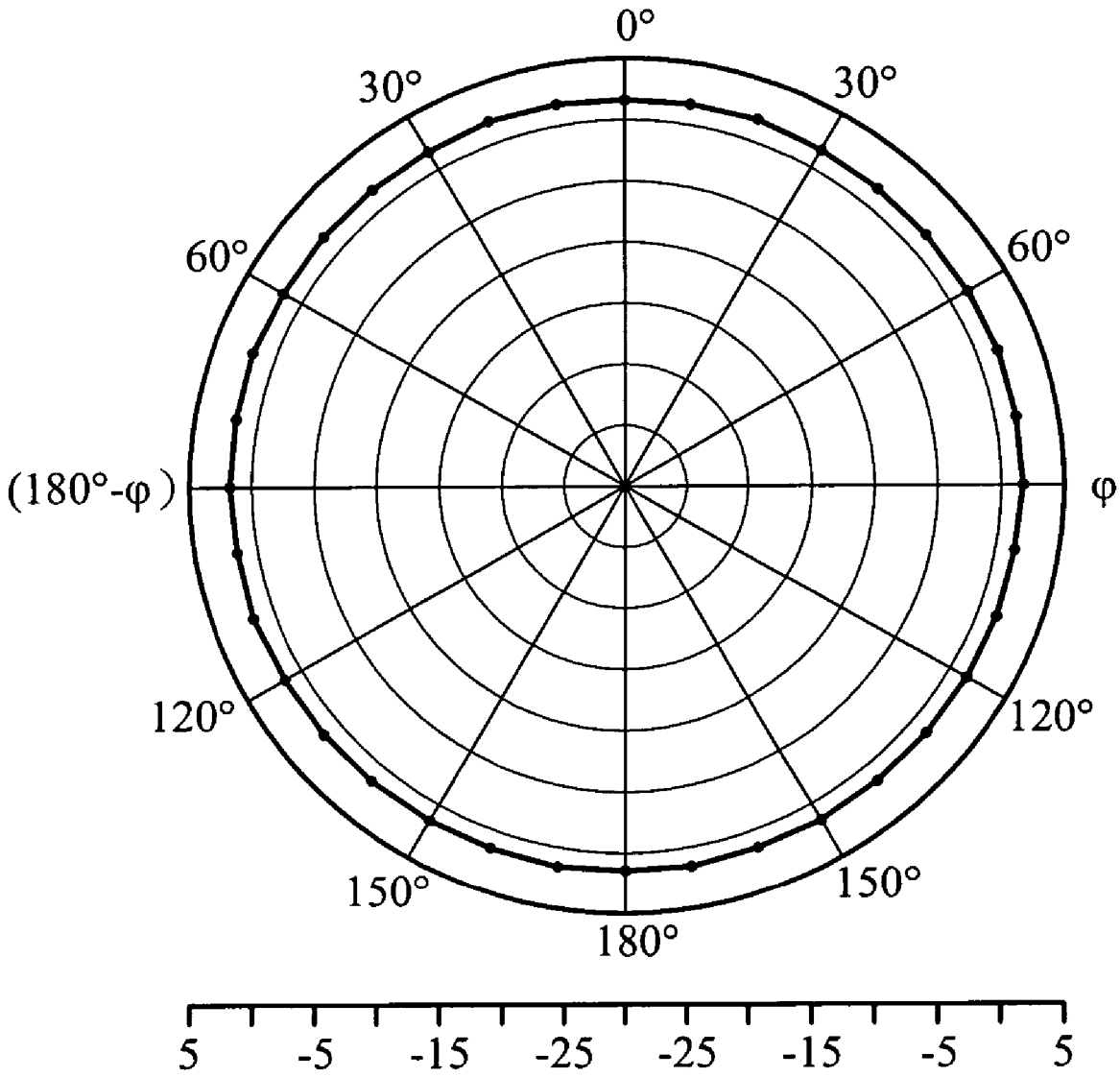
FIG. 3A illustrates the radiation pattern of an antenna according to a first exemplary embodiment of the present invention.
Figure 3B:
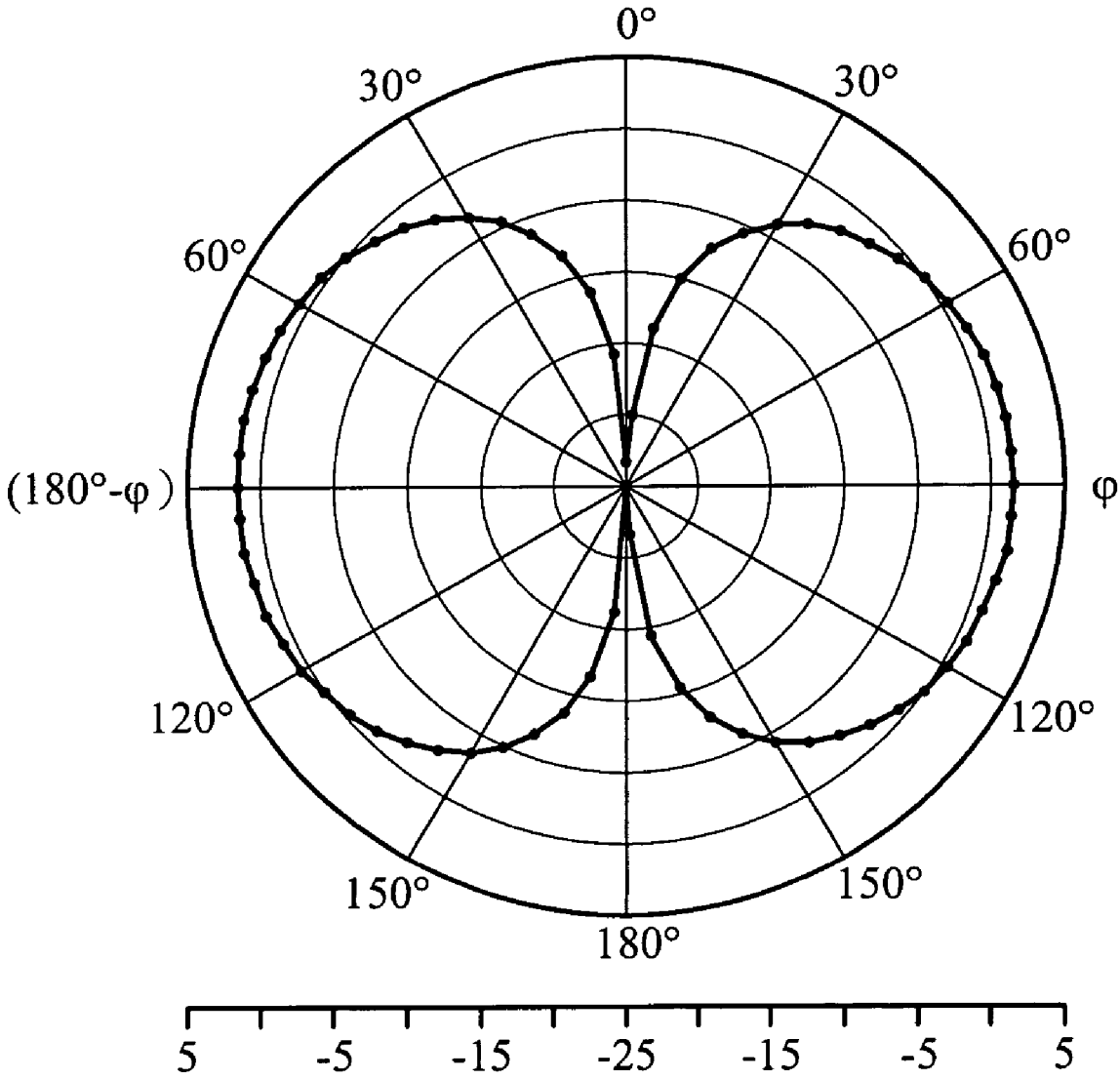
FIG. 3B illustrates the radiation pattern of an antenna according to a first exemplary embodiment of the present invention.

FIG. 3A illustrates the radiation pattern of an H-polarized antenna at a frequency of 2.4 GHz according to the first exemplary embodiment of the present invention. FIG. 3B illustrates the radiation pattern of a V-polarized antenna at a frequency of 2.4 GHz according to the first exemplary embodiment of the present invention.

Figure 3C:
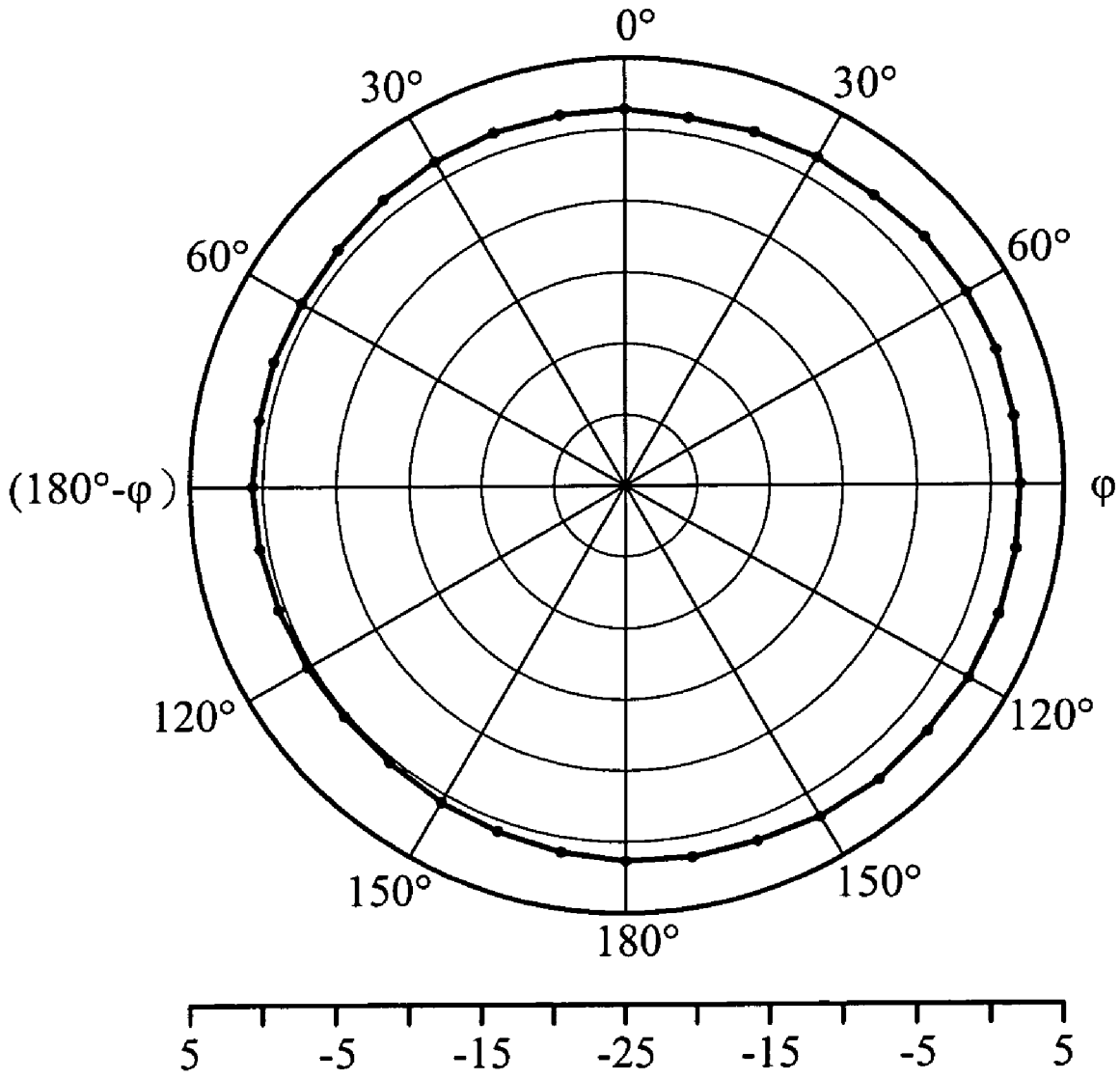
FIG. 3C illustrates the radiation pattern of an antenna according to a second exemplary embodiment of the present invention.
Figure 3D:
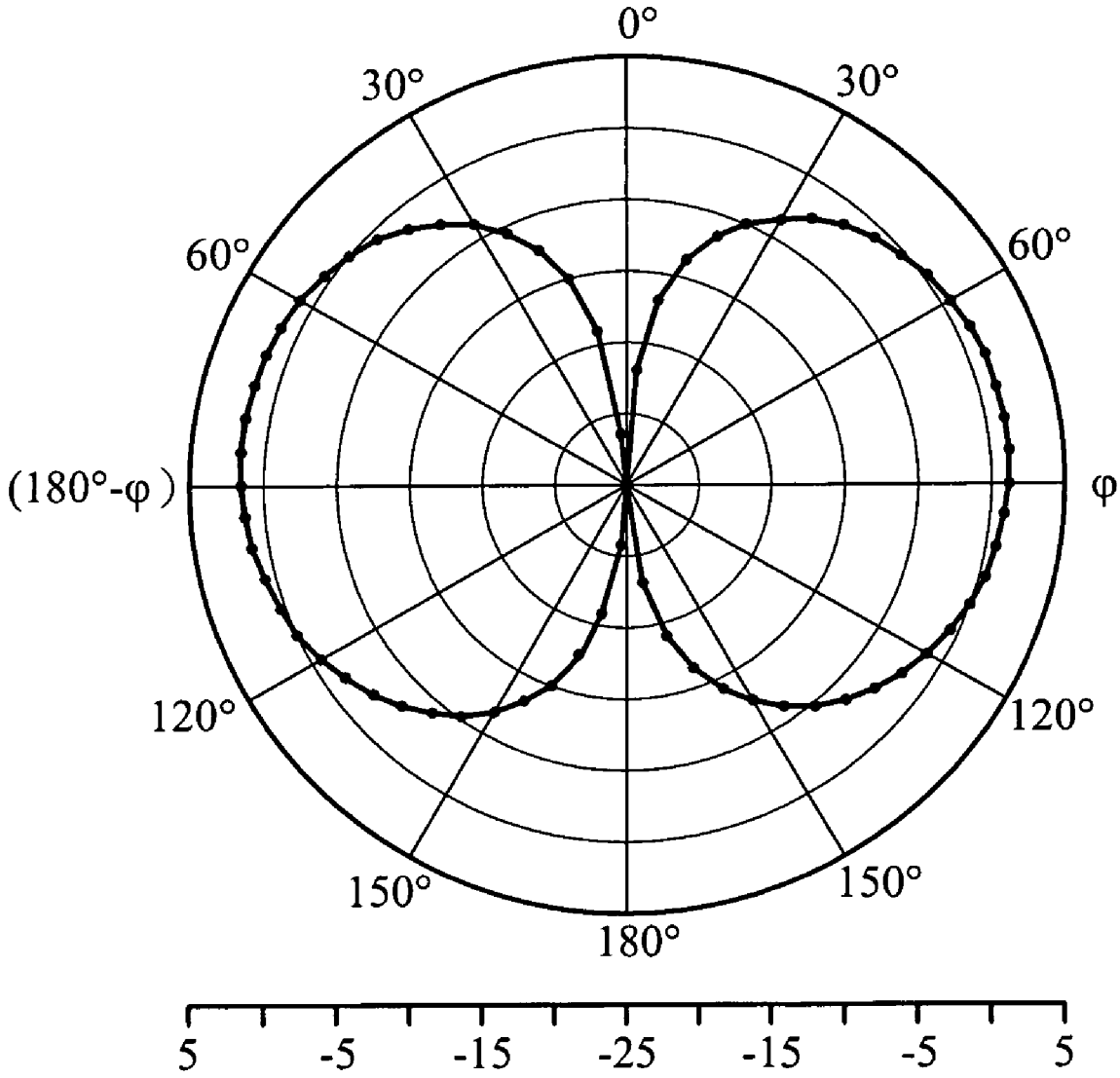
FIG. 3D illustrates the radiation pattern of the antenna according to a second exemplary embodiment of the present invention.

FIG. 3C illustrates the radiation pattern of an H-polarized antenna at a frequency of 2.4 GHz according to the second exemplary embodiment of the present invention. FIG. 3D illustrates the radiation pattern of a V-polarized antenna at a frequency of 2.4 GHz according to the second exemplary embodiment of the present invention.

The symmetric-slot monopole antenna according to the exemplary embodiments of the present invention may replace the printed dipole antenna to therefore reduce the size of antenna, and further reduce the cost and simplify the processes of antenna manufacture.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A symmetric-slot monopole antenna comprising:

a metallic board having a ground connection part and at least one radiation part formed thereon, wherein the ground connection part is formed integrally with the radiation part, the radiation part formed perpendicular to the plane of the ground connection part, the radiation part having a signal-feeding hole, the radiation part receiving and radiating a signal; and a signal cable having a signal terminal, the signal terminal inserted into the signal-feeding hole of the radiation part to connect the signal-feeding hole to receive the signal.

2. The symmetric-slot monopole antenna according to claim 1, wherein each of the at least one radiation part corresponds to two impedance matching slots, and each of the two impedance matching slots formed on the metallic board to match the impedance of the symmetric-slot monopole antenna.

3. The symmetric-slot monopole antenna according to claim 1, wherein the radiation part is of a length of ¼ λ (wavelength).

4. The symmetric-slot monopole antenna according to claim 1, wherein the signal cable further comprises a ground connection terminal connected to the ground connection part.

5. The symmetric-slot monopole antenna according to claim 1, wherein the radiation part is in the shape of a strip.

6. The symmetric-slot monopole antenna according to claim 1, wherein the radiation part is in the shape of a "T."

7. The symmetric-slot monopole antenna according to claim 1, wherein the symmetric-slot monopole antenna is an MIMO (multi-input multi-output) antenna.

8. The symmetric-slot monopole antenna according to claim 7, wherein the multi-input multi-output antenna is arranged in a row.

9. The symmetric-slot monopole antenna according to claim 7, wherein the multi-input multi-output antenna is arranged in a column.

10. The symmetric-slot monopole antenna according to claim 1, wherein the signal-feeding hole is formed on lower end of the radiation part near the ground connection part.

* * * * *